US006152823A

United States Patent [19]

Lacoste et al.

[11] Patent Number: 6,152,823

[45] Date of Patent: Nov. 28, 2000

[54] GAIN DETERMINATION METHOD AND GAMING APPARATUS

[75] Inventors: Rémi Lacoste; Harold Thibault, both of Montréal; Serge Roy, St-Joseph-du-Lac, all of Canada

[73] Assignee: Loto-Quebec, Montreal, Canada

[21] Appl. No.: 09/250,684

[22] Filed: Feb. 16, 1999

[30] Foreign Application Priority Data

Oct. 9, 1998 [CA] Canada ..... 2249900

[51] Int. Cl.[7] ..... A63F 9/24

[52] U.S. Cl. ..... 463/25; 463/16

[58] Field of Search ..... 463/25, 26, 27, 463/40, 16, 17, 18, 19, 20, 21, 28, 41, 42, 9, 10, 11, 12, 13

[56] References Cited

U.S. PATENT DOCUMENTS

| | | | |
|---|---|---|---|
| 4,652,998 | 3/1987 | Koza et al. . | |
| 4,837,728 | 6/1989 | Barrie et al. . | |
| 5,292,127 | 3/1994 | Kelly et al. . | |
| 5,326,104 | 7/1994 | Pease et al. . | |
| 5,564,700 | 10/1996 | Celona | 463/27 |
| 5,741,183 | 4/1998 | Acres et al. | 463/42 |
| 5,743,525 | 4/1998 | Haddad . | |
| 5,743,797 | 4/1998 | Jannersten | 463/11 |
| 5,951,397 | 9/1999 | Dickinson | 463/36 |
| 6,007,426 | 12/1999 | Kelly et al. | 463/16 |
| 6,077,162 | 6/2000 | Weiss | 463/26 |

FOREIGN PATENT DOCUMENTS

WO95/05876 3/1995 WIPO .

*Primary Examiner*—Jessica J. Harrison
*Assistant Examiner*—Julie Kasick
*Attorney, Agent, or Firm*—Quarles & Brady LLP

[57] ABSTRACT

A gain determination method and a gaming apparatus therefor are described herein. The gain determination method is intended to create an interaction between the players of games of chance and money. To achieve this, the gain determination method of the present invention is based on the principle that the number of players that win the game determines the gain of each player. An embodiment of the apparatus includes four gaming stations that are linked to a controller. If the number of players is sufficient and if the controller detects that more than one player wins the game, the gain of each winning player is multiplied by a variable that increases with the number of winning players.

13 Claims, 4 Drawing Sheets

GAIN DETERMINATION METHOD AND GAMING APPARATUS

FIELD OF THE INVENTION

The present invention relates to a gain determination method. More specifically, the present invention is concerned with a gain determination method where the gain of each winning player is determined as a function of the number of winning players.

BACKGROUND OF THE INVENTION

Various strategies have been devised in view of increasing the involvement of players in games of chance and money.

Most of these strategies revolve around progressive jackpot payout systems. In essence, these systems involve a plurality of casino gaming machines, such as, for example, slot machines, linked to a central controller running a jackpot calculating program. This program increases the amount of the jackpot each time one of the gaming machine is used. The players are therefore tempted to play the linked gaming machines more often to increase their chances of winning the progressive jackpot.

It is however to be noted that there is little interaction between the players of the linked gaming machines. Indeed, each player plays his own game. Furthermore, if the progressive jackpot is won by a player, it is detrimental to the other players since the amount of the jackpot is usually brought back to a predetermined minimal amount.

There is therefore no incentive to play the progressive jackpot game systems as a group of players, where each player may positively influence the gains of every winning players.

OBJECTS OF THE INVENTION

An object of the present invention is therefore to provide an improved gain determination method and a gaming apparatus therefor.

SUMMARY OF THE INVENTION

More specifically, in accordance with the present invention, there is provided a gain determination method comprising the steps of:

providing at least two gaming stations; each of the gaming stations being so configured as to a) accept a bet from a player; b) perform a play cycle; c) determine a play cycle result;

collecting play cycle result data from each gaming stations;

calculating a number of winning results;

determining the gain of each winning player as a function of the number of winning results.

According to another aspect of the present invention, there is provided a gain determination method comprising the steps of:

providing a controller;

providing at least two gaming stations connected to the controller; each gaming stations being so configured as to a) accept a bet from a player to therefore allow the player to play; b) transmit betting data to the controller;

generating a play cycle at least partially controlled by the player of each playing gaming station;

collecting a play cycle result for each playing gaming station to identify winning players;

calculating a number of winning results;

determining the gain of each winning player as a function of the number of winning results.

According to yet another aspect of the present invention, there is provided a gaming apparatus comprising:

a controller;

at least two gaming stations connected to the controller; each gaming station being provided with a bet accepting device, game controls and a display;

wherein the controller is so configured as to a) perform a play cycle at least partially controlled by the player of each playing gaming station, b) generate a play cycle result for each playing gaming station to determine winning gaming stations, c) determine a number of winning results and d) calculate the gain of each winning playing stations as a function of the number of winning results.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENT

Figure 1:
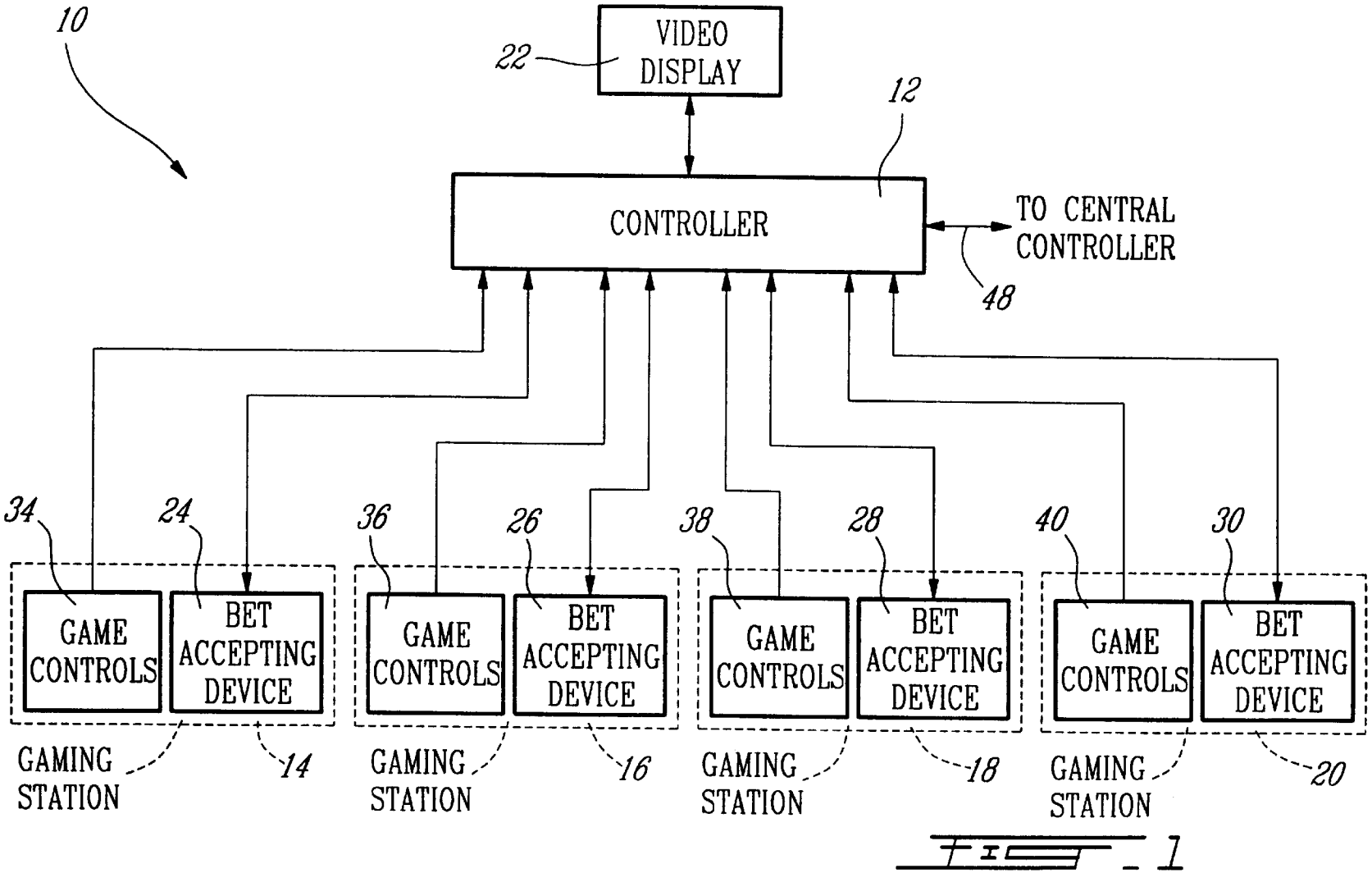
FIG. 1 is a block diagram of a gaming apparatus according to an embodiment of the present invention.
Figure 2:
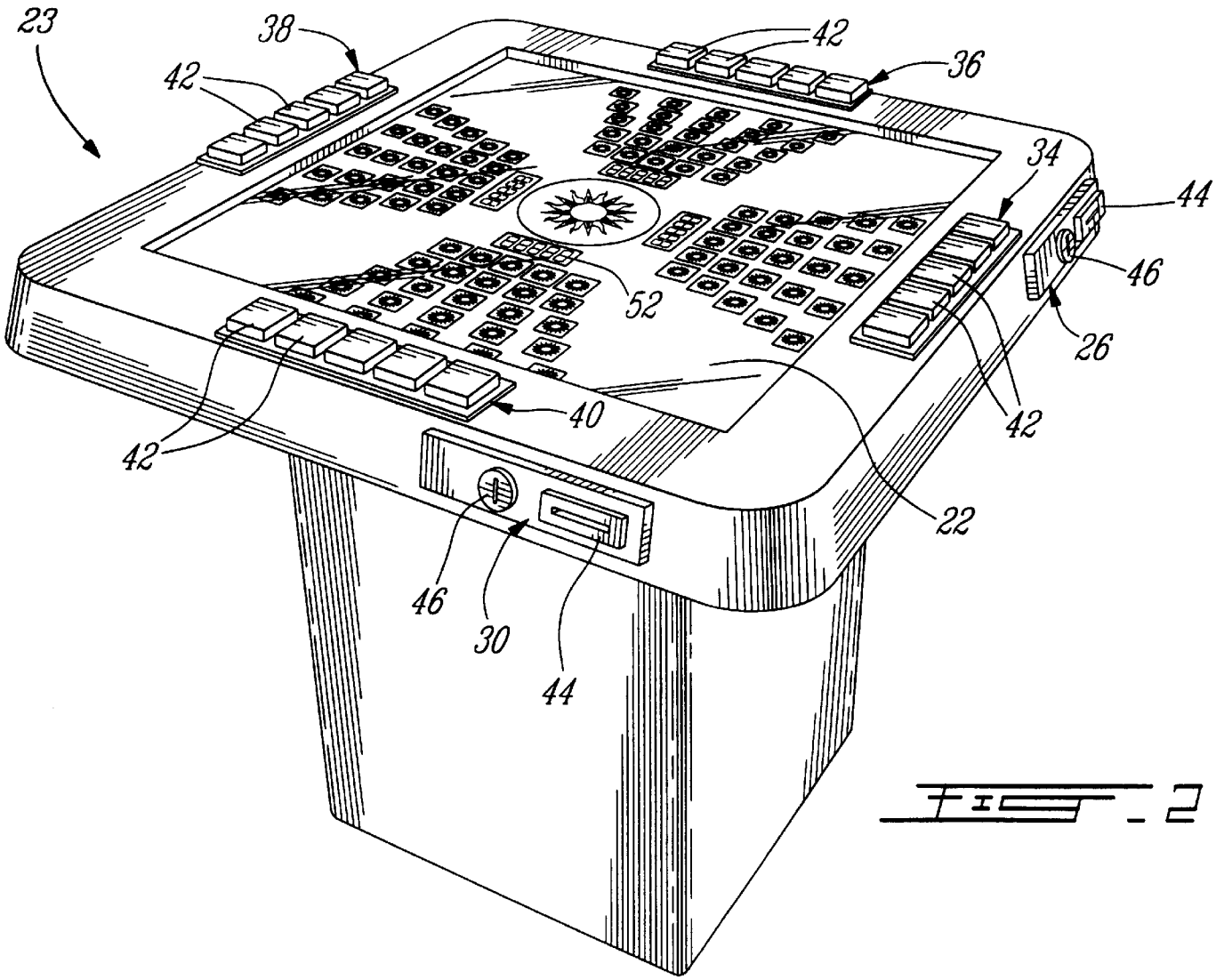
FIG. 2 is a perspective view of the gaming apparatus of FIG. 1.
Figure 3:
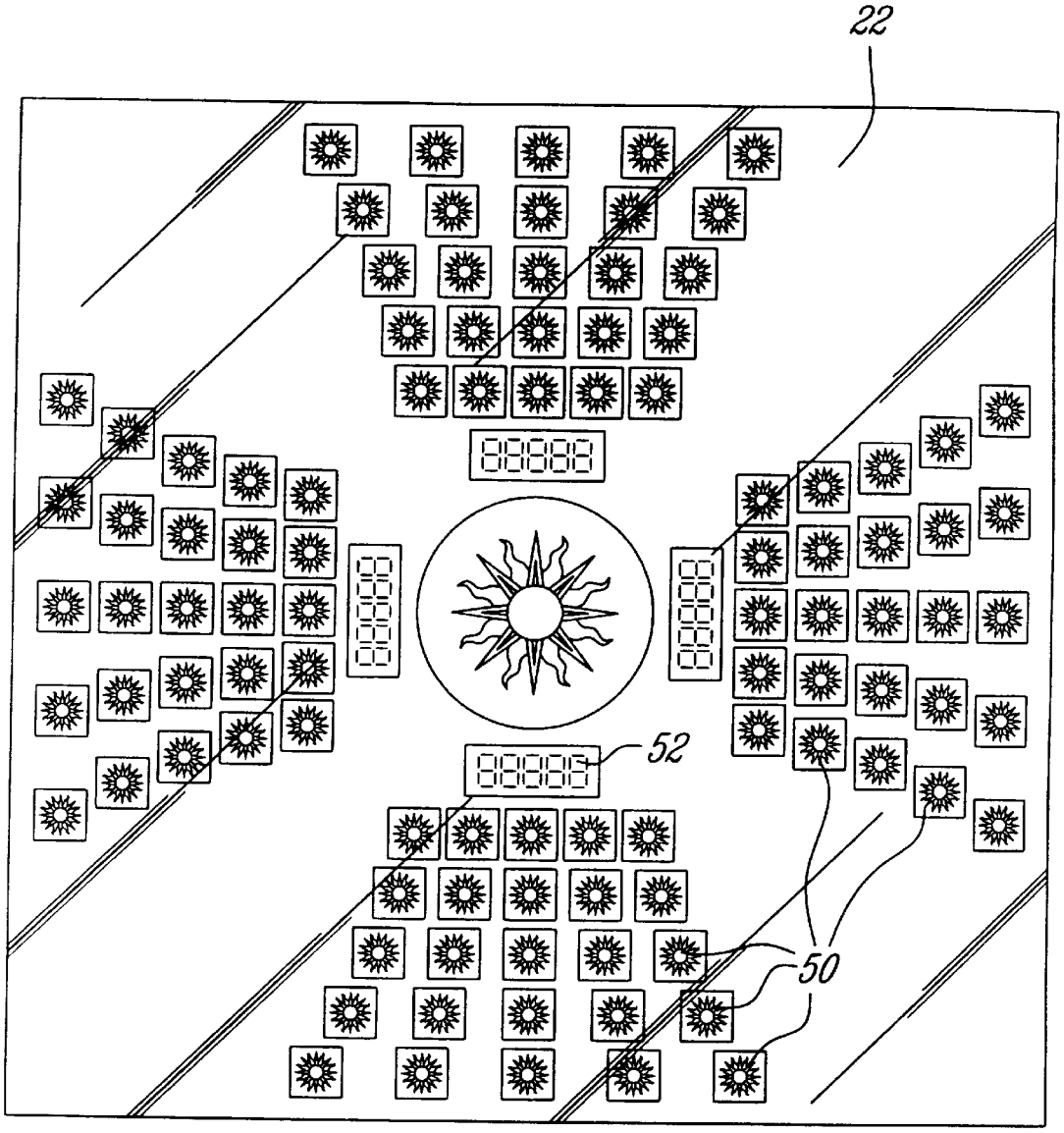
FIG. 3 is a top plan view of the display portion of the gaming apparatus of FIG. 1.

Turning now to FIGS. 1 to 3 of the appended drawings, a gaming apparatus 10 according to an embodiment of the present invention will be described.

The gaming apparatus 10 includes a controller 12, four gaming stations 14, 16, 18 and 20, and a video display 22. As can be better seen from FIG. 2, these components of the gaming apparatus 10 are so mounted in a cabinet 23 that four players (not shown) may take place around the gaming apparatus 10 to play simultaneously.

Of course, the number of gaming stations is not limited to four, but is limited by the size of the cabinet 23.

Returning to FIG. 1, gaming stations 14, 16, 18 and 20 include respective bet accepting devices 24, 26, 28 and 30, and respective game controls 34, 36, 38 and 40. Each bet accepting devices and game controls are connected to the controller 12 to be controlled thereby.

The game controls 34–40 each includes push buttons 42 (FIG. 2) that may be actuated by the players to control the game.

The bet accepting devices 24–30 each includes an integrated circuit (IC) card reader 44 and/or a coin acceptor 46 (FIG. 2) to enable players to place their bet. Of course, a money bill acceptor (not shown) or any other system allowing secure transactions between the gaming station and the controller could also be used.

As can be seen from FIG. 1, the controller 12 is connected to the central controller of the casino via an electrical cable 48. This connection enables the casino to oversee the operation of the gaming apparatus 10. This connection also enables the central controller to shut down the gaming apparatus 10 should this be required. The controller 12 could be embodied, for example, by a personal computer (PC) running an adequate software program.

Turning now more specifically to FIG. 3 of the appended drawings, an example of a game of chance and money that may be played on the gaming apparatus 10 will be described. In this game, each player is faced with 5 rows of 5 face-down virtual cards 50 each. Two types of virtual cards may be found: go-cards that allow the player to advance to the next row of cards and stop-cards that indicate that the game is lost. The player wins the game if the centre of the display 22 is reached without turning a stop-card, i.e. by turning one go-card on each row. The player virtually turns the cards via the push buttons 42 (FIG. 2).

As can also be seen from FIG. 3, each player also faces a gain indicating area 52 where the payout of the game in progress is indicated. As will be evident from the foregoing description, the payout of the game may change during the game.

It is to be noted that games that are not controlled by the player could also be used.

It is to be noted that the game controls 34, 36, 38 and 40 and the video display 22 could be embodied by a touch screen display (not shown). Also, even though the apparatus 10 is provided with one controller 12, this controller 12 could include four separate controllers (not shown) part of each gaming station 14, 16, 18 and 20, and connected to the central controller of the casino.

As will be easily understood by one skilled in the art, while the gaming stations 14, 16, 18 and 20 have been described hereinabove as being part of a single apparatus 10 and as sharing a video display 22, these gaming stations could be independent and connected to the controller 12 via electrical cables or include separate controllers connected to the central controller of the casino. The gaming stations could therefore be placed apart from one another and interconnected via electrical cables or via an electronic network. If this is the case, each station would advantageously be provided with a separate video display displaying indications of the number of stations currently in use and the number of winning stations. Also, the lot table displayed at each station could be updated in real time to inform the players of the possible payout as will be described hereinbelow.

An advantage of providing independent gaming stations linked to a central controller via a network is the possibility to link a great number players playing simultaneously without requiring the players to be physically in the same premises.

Of course, if the gaming stations are located in different premises, the bet accepting devices of the gaming stations may be embodied by software programs enabling secure money transactions via electronic networks.

The visual aspects and the rules of the game to be played on the game apparatus 10 could be modified at will without departing from the spirit and nature of the present invention.

It is to be noted that the games suitable to be played on the game apparatus 10 are games of chance and money where the odds may be calculated.

Figure 4:
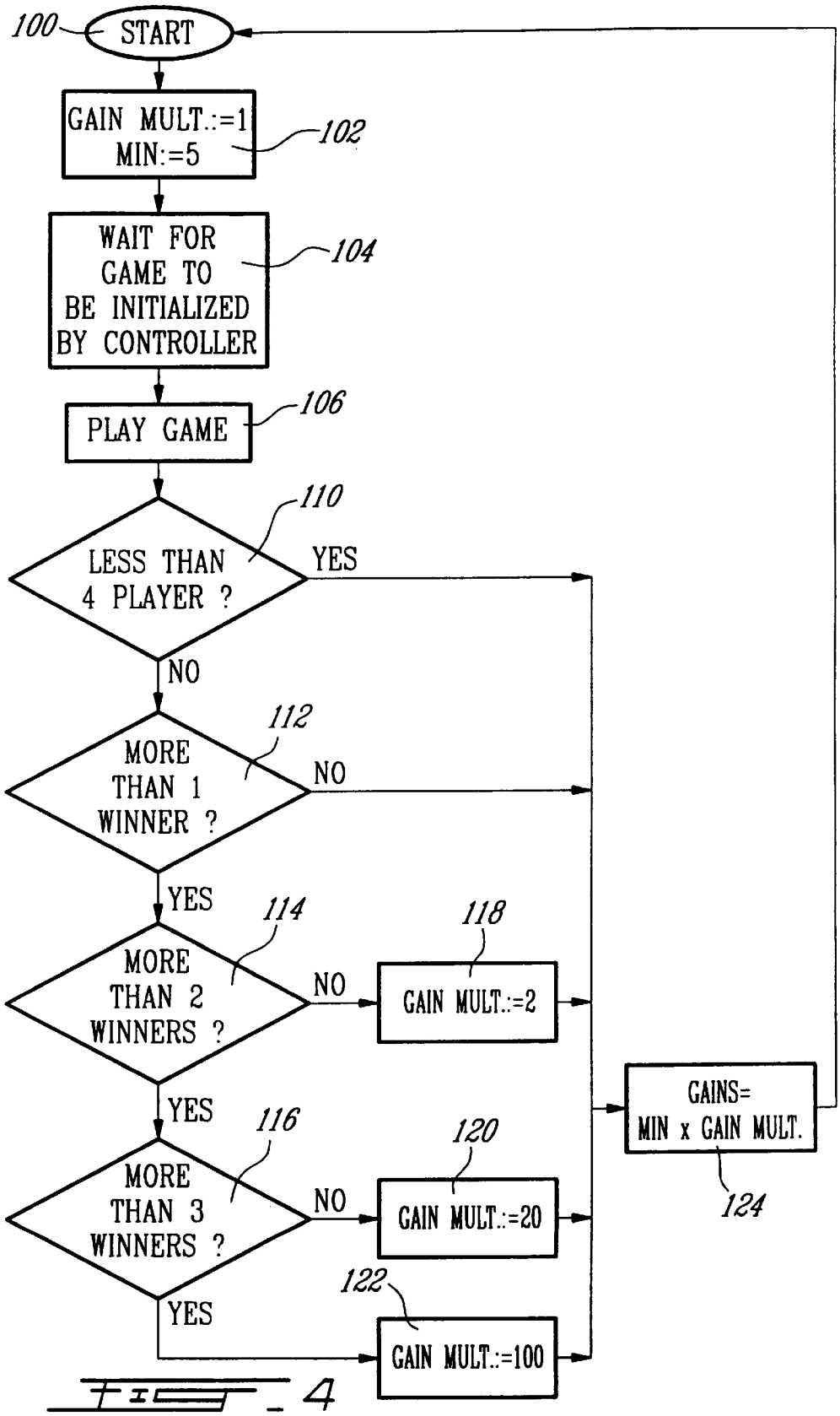
FIG. 4 is a flow chart illustrating an embodiment of the method of the present invention.

Turning now more specifically to FIG. 4 of the appended drawings, the method of gain determination will be described.

Generally stated, the purpose of the gain determination method of the present invention is to create an interaction between the players of games of chance and money. To achieve this, the gain determination method of the present invention is based on the principle that the number of players that win the game determines the gain of each player. To give an example of a possible payout table, if four players play the game, each betting one dollar, the following table indicates the gain of each winning player for different game outcomes:

| Outcome | Gain for each winner |
|---|---|
| 1 winner | 5 $ |
| 2 winners | 10 $ |
| 3 winners | 100 $ |
| 4 winners | 500 $ |

Each player is therefore stimulated when another player wins the game since it increases the potential gains of every player.

FIG. 4 is a schematized flow chart illustrating an embodiment of the gain determination method of the present invention. Each step of the method described hereinafter is done in the controller 12 of the gaming apparatus 10 with data supplied from the gaming stations 14, 16, 18 and 20 and data contained in the controller 12.

In step 100, the game apparatus 10 is started. This may be done, for example, by the central controller of the casino via the electrical cable 48.

In the second step 102, the controller is initialized. More specifically, a variable and a constant are set. A variable "Gain Mult" is set to 1. This variable is the gain multiplication variable that will be used to determine the gains of each player. A constant "Min" is set to 5. This constant is the minimum gain that a winning player may win. As will be better described hereinbelow, each player's gains are calculated as the product of the multiplication of "Gain Mult" and "Min".

The gaming apparatus then waits for a game to be initialized by the controller 12 in response to bets placed by players via the bet accepting devices 24, 26, 28 and/or 30 (step 104). The controller 12 may wait for a predetermined period of time after the first player has placed a bet, before initializing the game to give time to other potential players to join in.

The beginning of step 106 is the generation of a play cycle. In the game described hereinabove with reference to FIG. 3, the generation of the play cycle generally consists of determining the position of the go-cards and of the stop-cards for each players. After the generation of the play cycle, the face-down virtual cards are presented to the players and the game begins.

In the next step 110, the controller determines if less than four players have joined the game. If it is the case, the gain multiplication possibilities are not used. Therefore, each winning player will win the minimum gain.

If four players are involved in the game, the gains of the winning players are subject to the gain multiplication possibilities of the gain determination method of the present invention.

Depending on the outcome (illustrated in steps 112, 114 and 116) of the four games played, the "Gain Mult" variable is set to 2 (step 118), 20 (step 120) or 100 (step 122).

In the final step 124, the gains of each winning player is determined by multiplying the "Min" constant by the "Gain Mult" variable.

Of course, this is only one way to visualize the process. The controller could also be supplied with a look-up table which would be searched by the controller when gains of each winning player have to be determined.

It is to be noted that the schematized flow chart of FIG. 4 is for a gaming apparatus that accepts a fixed bet amount. If the gaming apparatus used accepts variable bets, it is believed to be within the skills of one skilled in the art to design a system where the "Min" constant would be replaced by a variable that would vary with the amount waged by the players.

It is also to be noted that the flow chart of FIG. 4 is greatly simplified, showing only the important steps of the operation of the gain determination method. It is believed that one skilled in the art could easily program the controller 12 adequately.

It is finally to be noted that the flow chart of FIG. 4 is concerned with a four gaming stations system. However, if more than four gaming stations are associated with the controller, the gain determination method may easily be adjusted to have regard for both the number of playing stations and the number of winning stations to thereby subject the gains of each winning players to the game determination possibilities of the method of the present invention even if all the gaming stations are not used.

Although the present invention has been described hereinabove by way of preferred embodiments thereof, it can be modified, without departing from the spirit and nature of the subject invention as defined in the appended claims.

What is claimed is:

1. A gain determination method comprising the steps of:

providing at least two gaming stations; each of said gaming stations being so configured as to a) accept a bet from a player; b) perform a play cycle; c) determine a play cycle result;

collecting play cycle result data from each of said gaming stations;

calculating a number of winning results;

determining the gain of each winning player as a multiplicative function of the number of winning results.

2. A gain determination method as recited in claim 1, wherein said collecting step is done by a controller connected to the at least two gaming stations.

3. A gain determination method as recited in claim 2, wherein said number of winning result calculating step is done by the controller.

4. A gain determination method as recited in claim 1, wherein a portion of the play cycle is controlled by the player.

5. A gain determination method comprising the steps of:

providing a controller;

providing at least two gaming stations connected to said controller; each of said gaming stations being so configured as to a) accept a bet from a player to therefore allow the player to play; b) transmit betting data to the controller;

generating a play cycle for each playing gaming station; a portion of said play cycle being controlled by the player;

collecting a play cycle result for each playing gaming station to identify winning players;

calculating a number of winning results;

determining the gain of each winning player as a multiplicative function of the number of winning results.

6. A gain determination method as recited in claim 5, wherein said play cycle generating step is done by the controller.

7. A gain determination method as recited in claim 5, wherein said play cycle result collecting step is done by the controller.

8. A gain determination method as recited in claim 5, wherein said number of winning results calculating step is done by the controller.

9. A gaming apparatus comprising:

a controller;

at least two gaming stations connected to said controller; each gaming station being provided with a bet accepting device, game controls and a display;

wherein said controller is so configured as to a) perform a play cycle for each playing gaming station, b) generate a play cycle result for each playing gaming station to determine winning gaming stations, c) determine a number of winning results and d) calculate the gain of each winning gaming stations as a multiplicative function of the number of winning results.

10. A gaming apparatus as recited in claim 9, further comprising a single video display onto which data from each said at least two gaming stations is displayed.

11. A gaming apparatus as recited in claim 10, wherein said single video display and said game controls of each said at least two gaming stations are incorporated in a touch screen display.

12. A gaming apparatus as recited in claim 9, wherein said bet accepting device includes an IC card reader.

13. A gaming apparatus as recited in claim 9, wherein said bet accepting device includes a coin acceptor.

* * * * *